US007630664B2

(12) United States Patent
Ozawa et al.

(10) Patent No.: US 7,630,664 B2
(45) Date of Patent: Dec. 8, 2009

(54) CLEANING DEVICE AND IMAGE FORMING DEVICE

(75) Inventors: Junichi Ozawa, Kanagawa (JP); Katsuya Takenouchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 333 days.

(21) Appl. No.: 11/640,343

(22) Filed: Dec. 18, 2006

(65) Prior Publication Data

US 2008/0003012 A1 Jan. 3, 2008

(30) Foreign Application Priority Data

Jun. 30, 2006 (JP) ..... 2006-182578

(51) Int. Cl.
*G03G 15/02* (2006.01)

(52) U.S. Cl. ..... 399/100

(58) Field of Classification Search ..... 399/100, 399/174, 176

See application file for complete search history.

(56) References Cited

FOREIGN PATENT DOCUMENTS

| | | |
|---|---|---|
| JP | A-5-297690 | 11/1993 |
| JP | A-2005-24675 | 1/2005 |
| KR | 10-2004-0046652 | 6/2004 |

*Primary Examiner*—Hoang Ngo
(74) *Attorney, Agent, or Firm*—Morgan, Lewis & Bockius LLP

(57) ABSTRACT

A cleaning device of a charging roller has: a cleaning member contacting a charging roller which charges an image carrier which carries an image, and cleaning a surface of the charging roller; and a holding structure holding the cleaning member such that the cleaning member is movable at least between a first position and a second position along a peripheral direction of the charging roller. The holding structure holds the cleaning member such that an amount of compression of the cleaning member at a contacting portion of the charging roller and the cleaning member is greater at the second position than at the first position.

15 Claims, 10 Drawing Sheets

FIG.9

| | AMOUNT OF COMPRESSION (mm) OF CHARGING ROLLER 14 AND CLEANING MEMBER 108 | | | | | | | | | | | | |
|---|---|---|---|---|---|---|---|---|---|---|---|---|---|
| | 0.00 | 0.10 | 0.20 | 0.30 | 0.40 | 0.50 | 0.60 | 0.70 | 0.75 | 0.80 | 0.85 | 0.90 | 1.00 |
| INDEX 1 | × | × | × | × | ○ | ○ | ○ | ○ | ○ | ○ | ○ | ○ | × |
| INDEX 2 | – | – | – | – | ○ | ○ | ○ | ○ | ○ | × | × | × | – |
| INDEX 3 | – | – | – | – | – | – | – | – | – | ○ | ○ | × | – |
| | | | | | | | | | | | | | |
| | | INDEX 1: CAN CHARGING ROLLER 14 CAUSE CLEANING MEMBER 108 TO MOVE FROM FIRST POSITION TO SECOND POSITION? | | | | | | | | | | | |
| | | INDEX 2: DOES CLEANING MEMBER 108 RETURN FROM SECOND POSITION TO FIRST POSITION WITH CHARGING ROLLER 14 STOPPED? | | | | | | | | | | | |
| | | INDEX 3: DOES CLEANING MEMBER 108 RETURN FROM SECOND POSITION TO FIRST POSITION WITH CHARGING ROLLER 14 ROTATING REVERSELY? | | | | | | | | | | | |

CLEANING DEVICE AND IMAGE FORMING DEVICE

BACKGROUND

1. Technical Field

The present invention relates to an image forming device, such as a copier or a printer or the like, which employs an electrophotographic method. In particular, the present invention relates to a cleaning device which cleans a charging roller which charges the surface of an image carrier which is driven to rotate, and to an image forming device which is equipped with the cleaning device.

2. Related Art

In a contact-charging method which carries out charging of an image carrier by causing a conductive charging roller to directly contact or to be very close to an image carrier, the generating of ozone and nitrogen oxides is greatly decreased, and the power source efficiency thereof also is good. Therefore, the contact-charging type method has become the mainstream method recently for charging devices of image forming devices, such as copiers or printers or the like, which employ an electrophotographic method.

In such a contact-charging method charging device, because the charging roller is always contacting or is always extremely close to the image carrier, there is the problem that it is easy for contamination due to foreign matter adhering to the surface of the charging roller to arise. Namely, at the downstream side of the transfer process, the surface of the image carrier, at which the image forming operation is repeatedly carried out, goes through a cleaning process which removes foreign matter such as residual toner and the like after the transfer, and thereafter, enters into the region of the charging process. However, even after going through the cleaning process, minute particles which are smaller than the toner, such as portions of the toner or external additives of the toner or the like, remain on the image carrier without being cleaned-off, and adhere to the surface of the charging roller. The foreign matter adhering to the surface of the charging roller causes non-uniformity in the surface resistance value of the charging roller, and is a cause of abnormal discharging or unstable discharging, and causes the uniformity of charging to deteriorate.

SUMMARY

A cleaning device of a first aspect of the present invention has: a cleaning member contacting a charging roller which charges an image carrier which carries an image, and cleaning a surface of the charging roller; and a holding structure holding the cleaning member such that the cleaning member is movable at least between a first position and a second position along a peripheral direction of the charging roller, the holding structure holding the cleaning member such that an amount of compression of the cleaning member at a contacting portion of the charging roller and the cleaning member is greater at the second position than at the first position.

BRIEF DESCRIPTION OF THE DRAWINGS

Exemplary embodiments of the present invention will be described in detail based on the following figures, wherein:

FIG. 9 is a table showing the evaluation of moving performance of the cleaning member in the Example of the present invention.

DETAILED DESCRIPTION

An image forming device relating to exemplary embodiments of the present invention will be described hereinafter with reference to the drawings.

(Structure of Image Forming Device)

Figure 1:
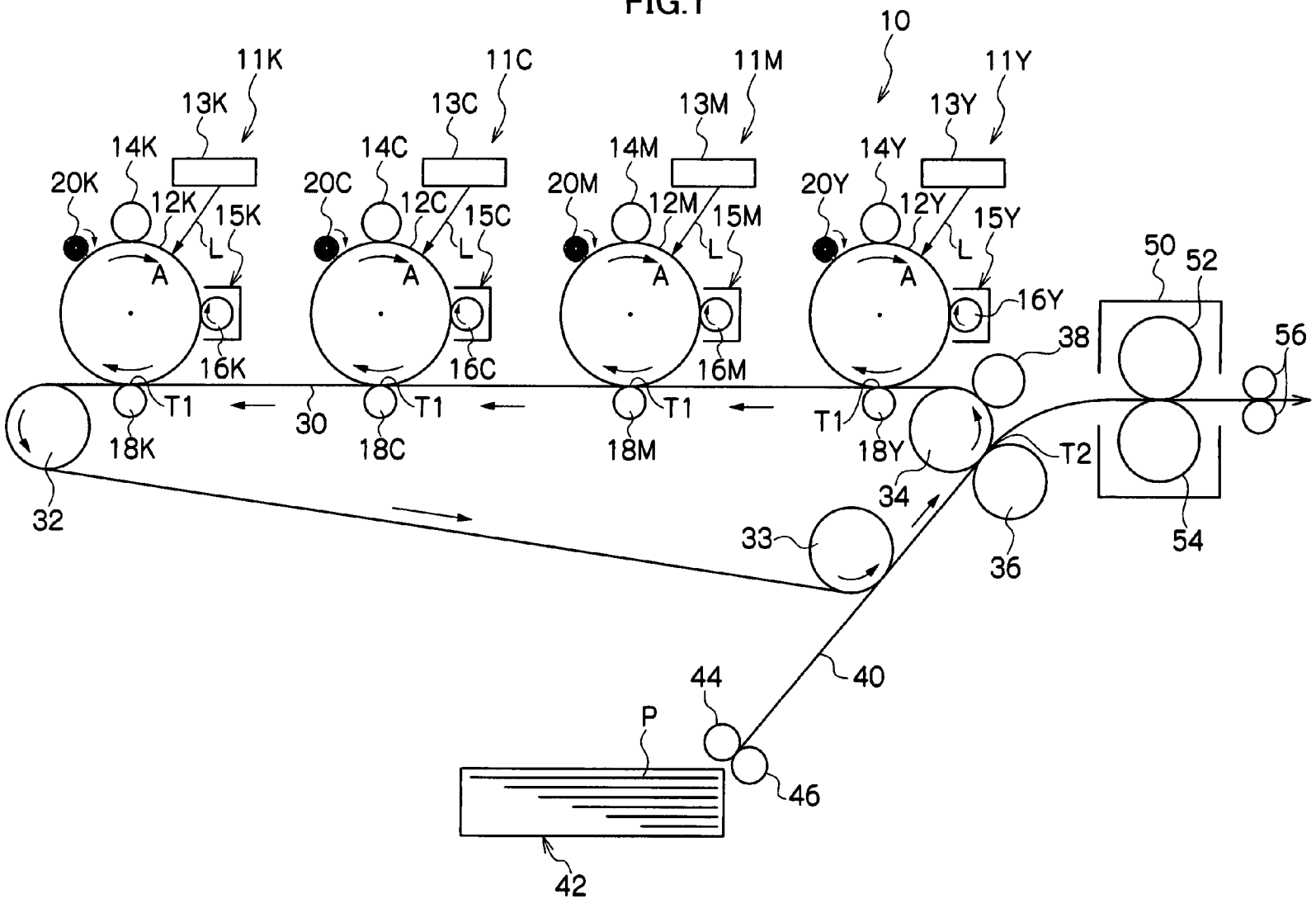
FIG. 1 is a structural diagram showing the schematic structure of an image forming device relating to exemplary embodiments of the present invention.

An image forming device 10 of the present exemplary embodiments which is shown in FIG. 1 is a four-drum tandem-type color copier. As shown in FIG. 1, image forming units 11 (11Y, 11M, 11C, 11K), which form toner images of the respective colors of yellow (Y), magenta (M), cyan (C), and black (K), are lined-up along the moving direction of an intermediate transfer belt 30.

Image carriers 12 (12Y, 12M, 12C, 12K) are provided at the image forming units 11. For example, conductive, cylindrical-tube-shaped bodies, whose surfaces are covered by photosensitive layers formed from organic photoconductors or the like, are used as the image carriers 12. The image carriers 12 are driven by unillustrated motors to rotate at a predetermined processing speed in the directions of arrows A (i.e., so as to rotate rightward) in FIG. 1.

Charging devices having charging rollers (contact chargers) 14 (14Y, 14M, 14C, 14K), which charge the surfaces of the image carriers 12, are disposed substantially directly above the image carriers 12. Exposure devices 13 (13Y, 13M, 13C, 13K), which irradiate the surfaces of the image carriers 12 charged by the charging devices with laser lights L and form electrostatic latent images, are disposed further above the image carriers 12.

Developing devices 15 (15Y, 15M, 15C, 15K) are disposed adjacent to the image carriers 12 at the right sides thereof. Developing rollers 16 (16Y, 16M, 16C, 16K), which develop the electrostatic latent images formed on the image carriers 12 into toner images of the respective colors of yellow (Y), magenta (M), cyan (C), and black (K), are provided at the developing devices 15.

The intermediate transfer belt 30, which is endless and on which are transferred the toner images made visible by the developing devices 15, is disposed beneath the image carriers 12. Primary transfer rollers 18 (18Y, 18M, 18C, 18K) are disposed so as to oppose the image carriers 12, with the intermediate transfer belt 30 nipped therebetween. The respective contacting portions of the image carriers 12 and the intermediate transfer belt 30 are primary transfer portions T1. A primary transfer bias which is positive is applied to the primary transfer rollers 18.

A cleaning member, which serve as photosensitive body cleaners which remove the transfer residual toner remaining on the image carriers 12 after the primary transfer, are disposed adjacent to the image carriers 12 at the left sides thereof. Brush rollers 20 (20Y, 20M, 20C, 20K) are provided at the cleaning member. The brush rollers 20 press-contact the outer peripheral surfaces of the image carriers 12, are driven to rotate in the direction opposite the direction of rotation of the image carriers 12, and rub the transfer residual toner off of the image carriers 12.

The intermediate transfer belt 30 is trained around a driving roller 32, a stretching roller 33, and a secondary transfer back-up roller 34, and rotates (moves) synchronously with the rotation of the image carriers 12 in the same direction. Further, the above-described image forming units 11Y, 11M, 11C, 11K are lined-up in series in that order with respect to the direction of movement of the intermediate transfer belt 30. In this way, the toner images on the image carriers 12 are primarily-transferred, at the respective primary transfer portions T1 and by the primary transfer rollers 18, onto the intermediate transfer belt 30 so as to be superposed one on another in the order of yellow (Y), magenta (M), cyan (C), black (B). The intermediate transfer belt 30 conveys this primarily-transferred toner image toward a secondary transfer portion T2 (secondary transfer roller 36) which will be described hereafter.

The secondary transfer roller 36 is disposed opposingly at the right side of the intermediate transfer belt 30, such that a sheet conveying path 40 is nipped therebetween. The contacting portion of the secondary transfer roller 36 and the intermediate transfer belt 30 is the secondary transfer portion T2. A secondary transfer bias which is negative is applied to the secondary transfer roller 36. In this way, the secondary transfer roller 36 is assisted by the secondary transfer back-up roller 34, and secondarily-transfers, onto a sheet P and at the secondary transfer portion T2, the toner image which was primarily-transferred on the intermediate transfer belt 30. Further, an intermediate transfer belt cleaner 38, which removes the transfer residual toner remaining on the intermediate transfer belt 30 after the secondary transfer, is provided above and to the right of the secondary transfer back-up roller 34 which rotates and supports the intermediate transfer belt 30.

A sheet feed tray 42, in which the sheets P are accommodated, is disposed beneath the intermediate transfer belt 30. A feed roller 44, which feeds the sheets P out from the sheet feed tray 42 to the sheet conveying path 40, and a retard roller 46, which separates one-by-one the sheets P which are fed-out, are provided in a vicinity of the right side of the sheet feed tray 42.

A fixing device 50, which has a heating roller 52 and a pressurizing roller 54 which oppose one another, is disposed at the sheet conveying path 40 at the downstream side of the secondary transfer portion T2. A pair of discharging rollers 56 are provided at the downstream side of the fixing device 50. The sheet conveying path 40 extends from the feed roller 44 and the retard roller 46, through the secondary transfer portion T2 and the fixing device 50, to the discharging rollers 56.

(Image Forming Operation of Image Forming Device)

The color image forming operation by the image forming device 10 of the present exemplary embodiments will be described next. When an image formation signal is inputted to the image forming device 10 and the image carriers 12 are driven to rotate, the charging rollers 14 are slave-rotated in accordance with the rotation of the image carriers 12, and the surfaces (outer peripheral surfaces) of the image carriers 12 are charged uniformly by the charging rollers 14. Then, the laser lights L are illuminated from the exposure devices 13 onto the surfaces of the image carriers 12 on the basis of the image formation signal. The surfaces of the image carriers 12 are exposed by these laser lights L, and electrostatic latent images are formed.

The electrostatic latent images formed on the image carriers 12 are developed into toner images of the respective colors of yellow (Y), magenta (M), cyan (C), and black (K) by the developing rollers 16 of the developing devices 15, and are primarily-transferred onto the intermediate transfer belt 30 at the primary transfer portions T1 so as to be superposed one on another. Further, the transfer residual toner which remains on the image carriers 12 after the primary transfer is rubbed-off and removed by the brush rollers 20.

On the other hand, the sheet P accommodated in the sheet feed tray 42 is fed-out by the feed roller 44, and is separated by the retard roller 46 such that only the uppermost sheet P is guided to the sheet conveying path 40. The sheet P is fed-in between the secondary transfer roller 36 and the secondary transfer back-up roller 34, i.e., to the secondary transfer portion T2, at a predetermined timing. At this secondary transfer portion T2, the toner image, which has been primarily-transferred onto the intermediate transfer belt 30, is secondarily-transferred onto the sheet P.

The sheet P on which the toner image has been transferred is conveyed along the sheet conveying path 40 to the downstream side and is guided to the fixing device 50, and the toner image is fixed by the heat and pressure of the heating roller 52 and the pressurizing roller 54. Then, the sheet P, on which an image has been formed by the fixing of the toner image, is discharged-out to an unillustrated catch tray by the discharging rollers 56. Further, the transfer residual toner, which remains on the image region of the intermediate transfer belt 30 after the secondary transfer, is rubbed-off and removed by the intermediate transfer belt cleaner 38. Due to the above-described operations, a color image is formed on the sheet P by the image forming device 10.

(Structure of Charging Roller and Cleaning Device)

Figure 2:
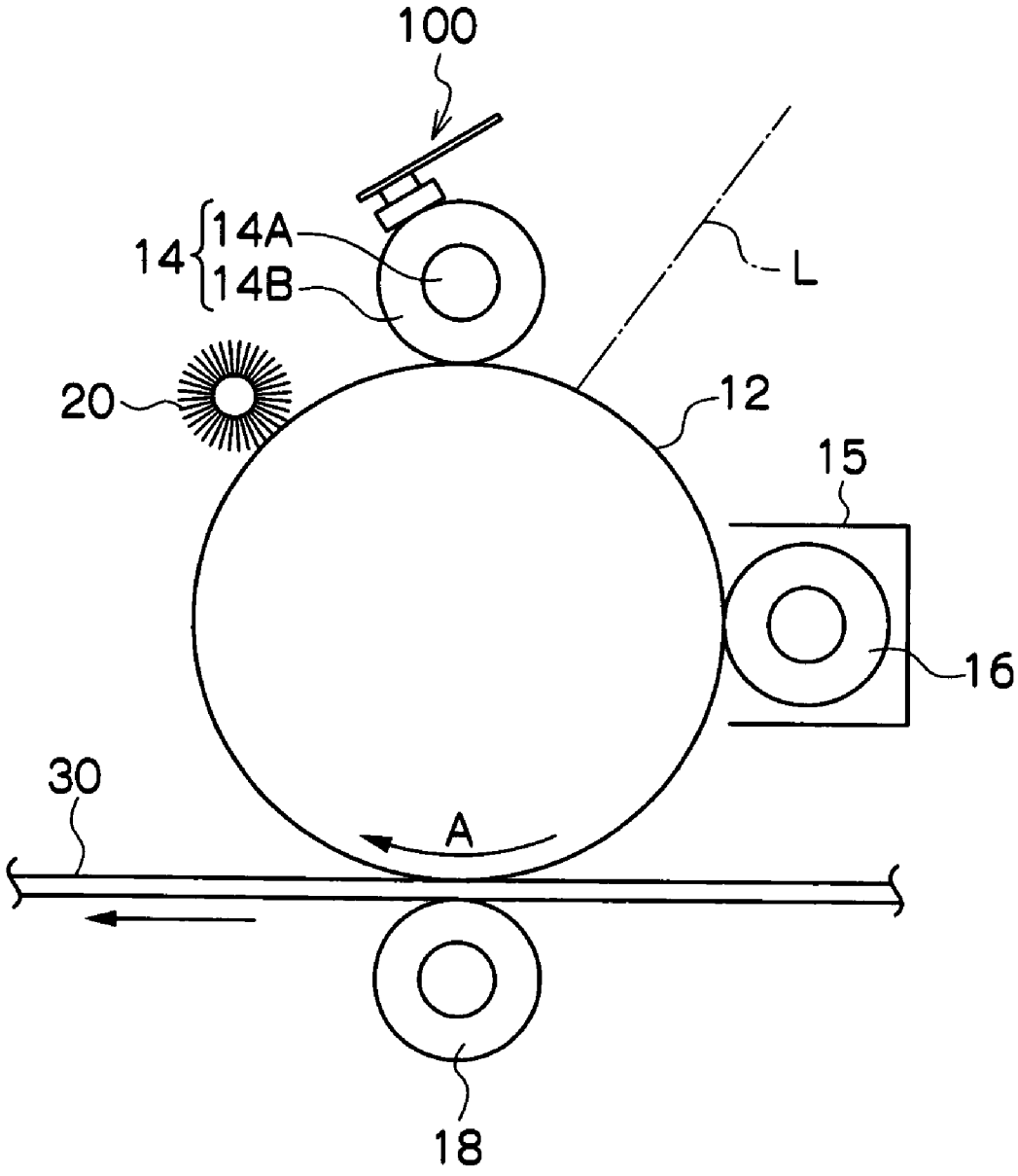
FIG. 2 is an enlarged view showing the structure of an image carrier, a charging roller, and a cleaning device provided in the image forming device of FIG. 1.

The charging rollers 14 provided at the image forming device 10 having the above-described structure, and cleaning devices 100 which clean the charging rollers 14, will be described in detail next. As shown in FIG. 2, the charging roller 14 is disposed above the image carrier 12 so as to contact the image carrier 12. The charging roller 14 is a structure in which a charging layer 14B is formed on the periphery of a conductive shaft 14A, and the shaft 14A is supported rotatably. The cleaning device 100, which contacts the surface of the charging roller 14 and extends along the axial direction, is provided above the charging roller 14.

As described above, the charging roller 14 is disposed so as to contact the surface of the image carrier 12, and dc voltage, or a voltage in which ac voltage is superimposed on dc voltage, is applied to the charging roller 14, and the charging roller 14 charges the surface of the image carrier 12. With regard to the configuration thereof, the charging roller 14 is shaped as a roller in which a resistant elastic layer structuring the charging layer 14B is provided on the periphery of a core structuring the shaft 14A. The resistant elastic layer may be structured so as to be divided into a resistant layer and an elastic layer which supports it, in that order from the outer side. Further, a protective layer can be provided on the outer side of the resistant layer as needed, in order to provide the charging roller 14 with durability and contamination-resistance.

A case in which an elastic layer, a resistant layer, and a protective layer are provided on a core will be described in further detail hereinafter. The material of the core is conductive, and generally, iron, copper, brass, stainless steel, aluminum, nickel, or the like is used. Materials other than metals may be used provided that they are materials which are conductive and have a proper degree of rigidity. For example, resin molded products in which conductive particles or the like are dispersed, or ceramics, or the like may be used. Further, other than the shape of a roller, the shape of a hollow pipe may be used.

The material of the elastic layer is conductive or semiconductive, and generally is a material in which conductive particles or semiconductive particles are dispersed in a resin material or a rubber material. Synthetic resins, such as polyester resin, acrylic resin, melamine resin, epoxy resin, urethane resin, silicon resin, urea resin, polyamide resin, and the like, or the like may be used as the resin material. Ethylene-propylene rubber, polybutadiene, natural rubber, polyisobutylene, chloroprene rubber, silicon rubber, urethane rubber, epichlorohydrin rubber, fluorosilicone rubber, ethylene oxide rubber, and the like, or foamed materials in which these materials are foamed, may be used as the rubber material.

Carbon black, metals such as zinc, aluminum, copper, iron, nickel, chromium, titanium and the like, metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO, MgO and the like ionic compounds such as quaternary ammonium salts and the like, and the like may be used as the conductive particles or semiconductive particles. A single type of these materials may be used, or two or more types may be mixed-together and used. Further, one type or two or more types of inorganic fillers such as talc, alumina, silica, and the like, or organic fillers such fine powders of fluorine resin or silicon rubber, or the like, may be mixed-together as needed.

The materials of the resistant layer and the protective layer are materials in which conductive particles or semiconductive particles are dispersed in a binder resin, and the resistance thereof is controlled. The resistivity is $10^3$ to $10^{14}$ Ωcm, and preferably $10^5$ to $10^{12}$ Ωcm, and more preferably $10^7$ to $10^{12}$ Ωcm. Further, the film thickness is 0.01 to 1000 μm, and preferably 0.1 to 500 μm, and more preferably 0.5 to 100 μm.

Acrylic resin, cellulose resin, polyamide resin, methoxymethylated nylon (trademark), ethoxymethylated nylon (trademark), polyurethane resin, polycarbonate resin, polyester resin, polyethylene resin, polyvinyl resin, polyarylate resin, polythiophene resin, polyolefin resins such as PFA, FEP, PET and the like, styrene-butadiene resin, melamine resin, epoxy resin, urethane resin, silicon resin, urea resin, or the like is used as the binder resin.

One type or two or more types of carbon black, metals, metal oxides, or ionic compounds such as quaternary ammonium salts or the like which manifest ion conductivity, such as those listed above in relation to the elastic layer, or the like are mixed-together as the conductive particles or the semiconductive particles. Further, one type or two or more types of antioxidants such as hindered phenol, hindered amine, and the like, inorganic fillers such as clay, kaolin, talc, silica, alumina, and the like, organic fillers such as fine powders of fluorine resin or silicon resin or the like, lubricants such as silicone oil or the like, and the like may be added as needed. Surfactants, charge controlling agents, and the like also are added as needed.

Blade coating, Meyer bar coating, spray coating, immersion coating, bead coating, air knife coating, curtain coating, or the like can be used as the methods for forming these layers.

FIRST EXEMPLARY EMBODIMENT

Figure 3:
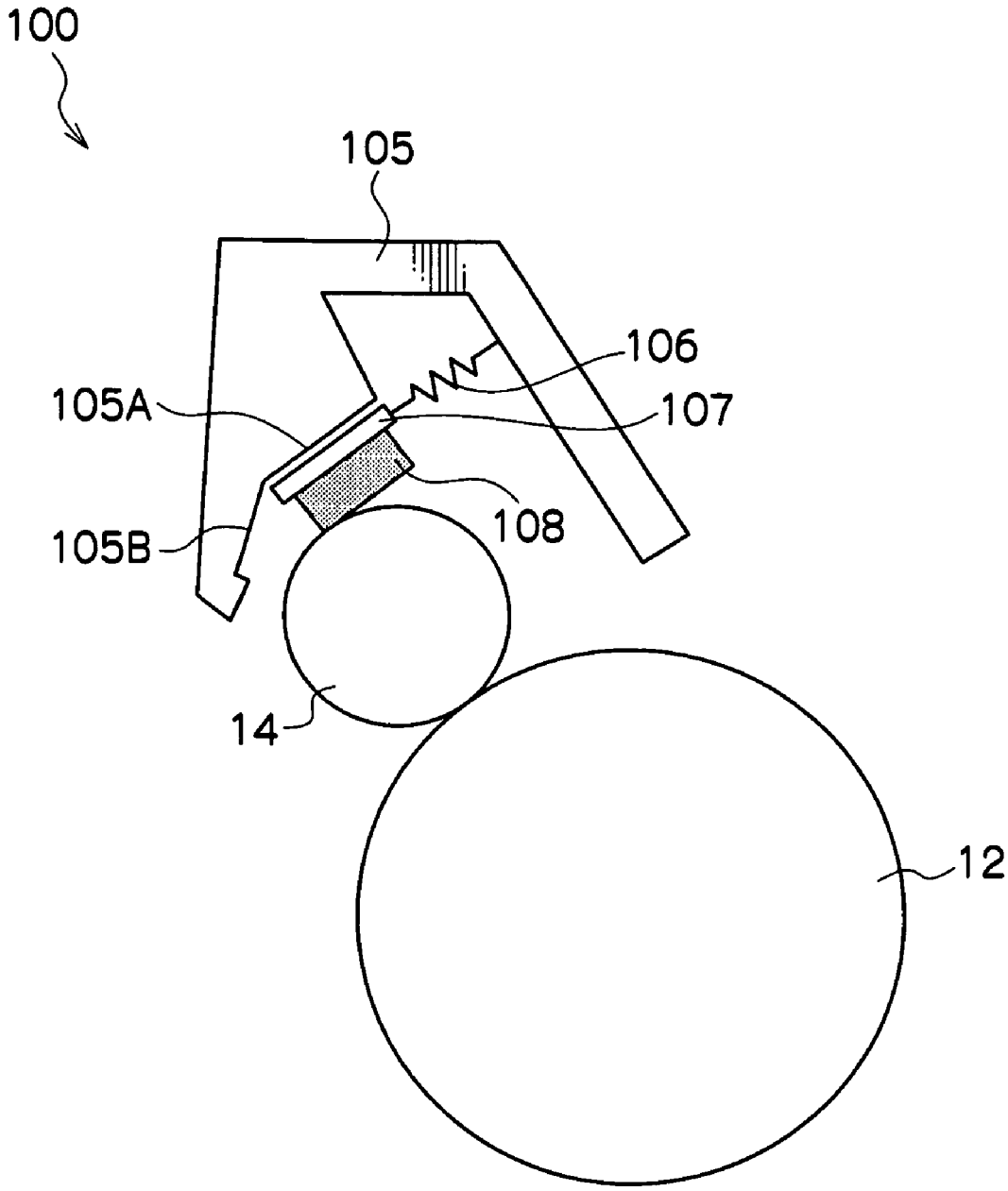
FIG. 3 is a first schematic diagram showing a cleaning device of a first exemplary embodiment of the present invention.

The cleaning device 100 of the charging roller 14 relating to a first exemplary embodiment of the present invention will be described next. As shown in FIG. 3, the cleaning device 100 relating to the present exemplary embodiment is disposed along the axial direction of the charging roller 14 (the direction orthogonal to the surface of FIG. 3). The cleaning device 100 is structured from a cleaning member 108 which is formed from an elastic body, and contacts the charging roller 14, and cleans the surface of the charging roller 14; a fixing member 107 to which the cleaning member 108 is fixed; a supporting member 105 which supports the cleaning member 108 and the fixing member 107; and urging members 106, such as compression springs or the like, disposed between the fixing member 107 and the supporting member 105.

The cleaning member 108 is a rectangular member formed by a foamed elastic body. The fixing member 107 is a rectangular member formed of a resin material. The cleaning member 108 and the fixing member 107 are joined together with surfaces thereof superposed one on the other. The urging members 106 are joined to the both axial direction end portions of the fixing member 107. Note that materials such as polyethylene terephthalate (PET), polyacetal (POM), polycarbonate (PC), and the like may be employed as the material of the fixing member 107. Further, for example, ether-based urethane foam, polyethylene foam, polyolefin foam, melamine foam, micropolymer, or the like may be used for the cleaning member 108.

To briefly describe the manufacturing method by using polyurethane foam as an example, polyol, isocyanate, water, a catalyst (an amine catalyst, a metal catalyst, or the like), and a foam stabilizer (surfactant) are used, and further, additives such as pigment or the like are used depending on the application. Then, when these raw materials are mixed-together and stirred, a chemical reaction takes place, and a foam of urethane resin can be obtained.

The supporting members 105 are formed of a synthetic resin material such as polyacetal, polycarbonate, or the like which has high rigidity, good slidability, and excellent wear-resistance. In order to further improve the wear-resistance, glass fibers or carbon fibers or the like may be included in the synthetic resin material.

Operation of the cleaning device 100 of the present exemplary embodiment will be described next. FIG. 3 shows the state of placement of the cleaning device 100 when the image forming device 10 is stopped. Namely, the image carrier 12 and the charging roller 14 both are in stopped states in which they do not rotate. In this case, as shown in FIG. 3, the cleaning member 108 is stationary at a standby position 105A which serves as a first position at the supporting member 105. At this standby position 105A, the cleaning member 108 contacts the charging roller 14 in a state in which the amount of compression at the contacting portion where the cleaning member 108 contacts the charging roller 14 is small, and deformation does not arise therebetween.

Figure 10B:
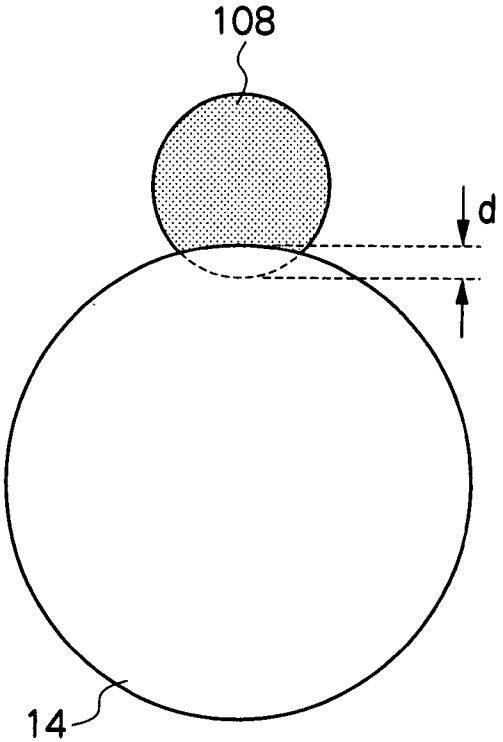
FIGS. 10A and 10B are diagrams explaining a compression amount of the cleaning member in the present invention.
Figure 10A:
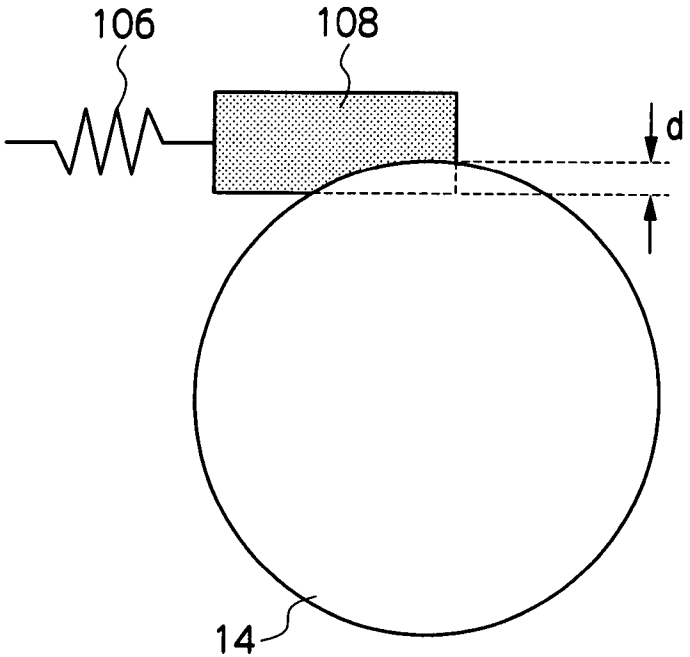

Note that the amount of compression in the exemplary embodiments of the present invention means the amount of compression from the free state before contact, in a case in which the cleaning member 108 is compressed due to contact with the charging roller 14. For example, as shown in FIGS. 10A and 10B, the amount of compression corresponds to an interference d by which the cleaning member 108 is interfered (bitten-into) by the charging roller 14.

In the direction of extension and contraction of the urging member 106, the relationship (frictional force F1+frictional force F2)≧urging force F3 is established among frictional force F1 which arises between the cleaning member 108 and the charging roller 14, frictional force F2 which arises between the fixing member 107 and the supporting member 105, and urging force F3 which the urging member 106 has. As mentioned previously, the cleaning member 108 is stationary in the arrangement shown in FIG. 3.

Figure 4:
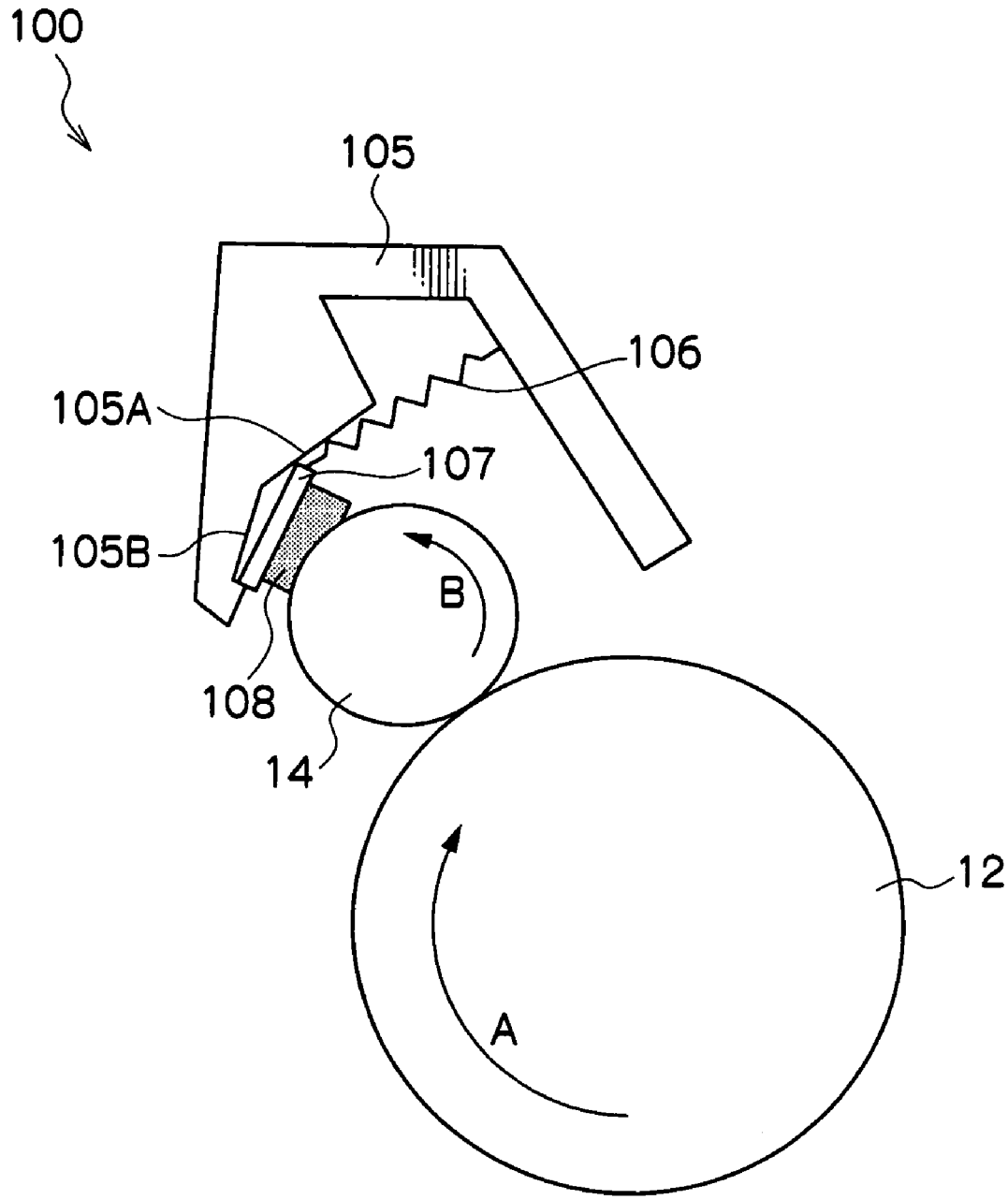
FIG. 4 is a second schematic diagram showing the cleaning device of the first exemplary embodiment of the present invention.

When the image forming device 10 which is equipped with such a cleaning device 100 operates, as shown in FIG. 4, due to the image carrier 12 rotating in the direction of arrow A, the charging roller 14 is slave-rotated and rotates in the direction of arrow B. At this time, the cleaning member 108 and the charging roller 14 are contacting one another at frictional force F1 until before the operation of the image forming device 10. Therefore, when the rotational force of the charging roller 14 is transferred to the cleaning member 108, the cleaning member 108 moves to the arrangement shown in FIG. 4.

While the image forming device 10 is operating, during the time that the charging roller 14 continues rotating, an equilibrium is maintained between the rotational force of the charging roller 14 transferred to the cleaning member 108 and the urging force arising at the urging member 106. As illustrated, the cleaning member 108 continues to clean the surface of the charging roller 14 at operation position 105B which serves as a second position at the supporting member 105.

The distance between the supporting member 105 and the charging roller 14 is set to be different at the standby position 105A shown in FIG. 3 and at the operation position 105B shown in FIG. 4. Namely, the interval between the charging roller 14 and the wall surface of the supporting member 105 at the operation position 105B, is set to be smaller than the interval between the charging roller 14 and the wall surface of the supporting member 105 at the standby position 105A. Therefore, when the cleaning member 108 moves from the standby position 105A to the operation position 105B, first, the fixing member 107 is pushed toward the charging roller 14.

In this way, the cleaning member 108 is pushed between the fixing member 107 and the charging roller 14, and, at the operation position 105B, resultingly contacts the charging roller 14 in a state in which the amount of compression is greater than at the standby position 105A. By making the pressing force of the cleaning member 108 with respect to the charging roller 14 at the operation position 105B be a pressing force such that the cleaning ability is good, the cleaning member 108 can continue to clean the surface of the charging roller 14 well.

Further, in the state in FIG. 4 in which the cleaning member 108 is positioned at the operation position 105B, if the image carrier 12 and the charging roller 14 stop at the image forming device 10, the cleaning member 108 returns to the standby position 105A by movement which is opposite to the movement described previously. Namely, when the rotational force of the charging roller 14 disappears, the cleaning member 108 and the fixing member 107 again move to the standby position 105A shown in FIG. 3 due to the urging force which the urging member 106 has.

Note that, in cases such as when foreign matter becomes mixed-in between the charging roller 14 and the cleaning member 108 during rotation, or when the pressing force at the operation position 105B is set to be large, or the like, regardless of the fact that the charging roller 14 is stopped, if the cleaning member 108 stops between the operation position 105B and the standby position 105A, the charging roller 14 may be rotated reversely for a predetermined time period by using a controller of the image forming device 10. In this case, the reverse rotation of the charging roller 14 may be set to a time period which is such that the urging member 106 is not compressed more than needed. Or, an unillustrated projecting portion may be provided at the supporting member 105, such that the cleaning member 108 does not move past the standby position 105A in the direction in which urging member 106 is compressed.

Second Exemplary Embodiment

Figure 5:
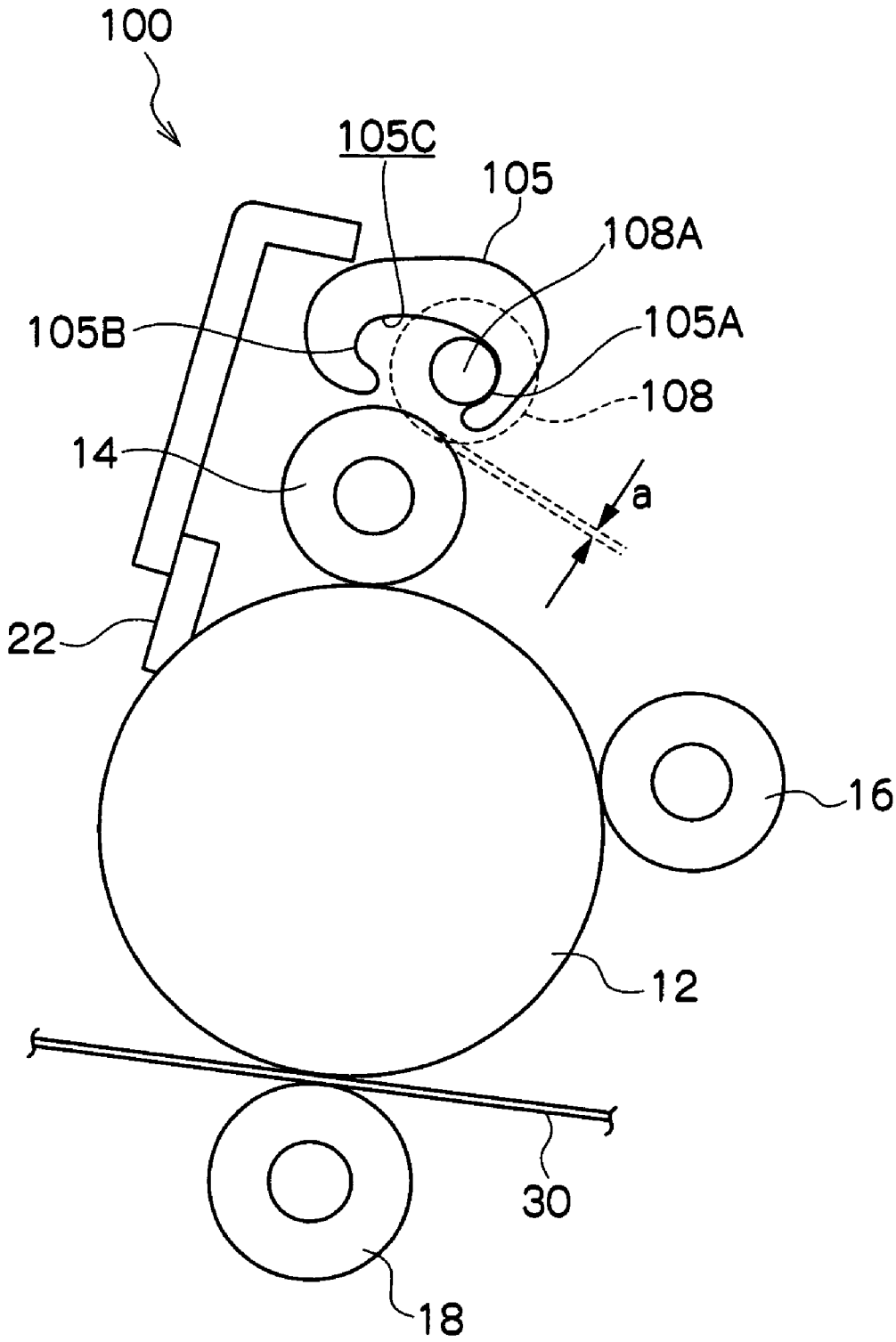
FIG. 5 is a first schematic diagram showing a cleaning device of a second exemplary embodiment of the present invention.

The cleaning device 100 of the charging roller 14 relating to a second exemplary embodiment of the present invention will be described next. As shown in FIG. 5, the second exemplary embodiment is structured from the image carrier 12, the charging roller 14, a cleaning blade 22 serving as a cleaning member and cleaning the surface of the image carrier 12, the cleaning member 108 which cleans the surface of the charging roller 14, and the supporting member 105 which supports the cleaning member 108. In this case, the cleaning member 108 is shaped as a roller, and is structured such that a material formed from the previously-mentioned polyurethane or the like is provided around a shaft 108A which is formed by a conductive member.

In the same way as in the above-described first exemplary embodiment, FIG. 5 shows a state in which the image forming device 10, which is equipped with the cleaning device 100 of the present exemplary embodiment, is stopped. In this case, the shaft 108A of the cleaning member 108 is disposed in a curved guide groove 105C which is formed in the supporting member 105. In particular, the position shown in FIG. 5 corresponds to the standby position 105A, and this arrangement exists at times when the image forming device 10 is not in use, such as when the image forming device 10 is in a standby state or the like. In this case, as shown in FIG. 5, the cleaning member 108 and the charging roller 14 are in a state of interference by distance a. At the amount of compression of this distance a, problems such as deformation between the cleaning member 108 and the charging roller 14, or the like, do not arise.

Figure 6:
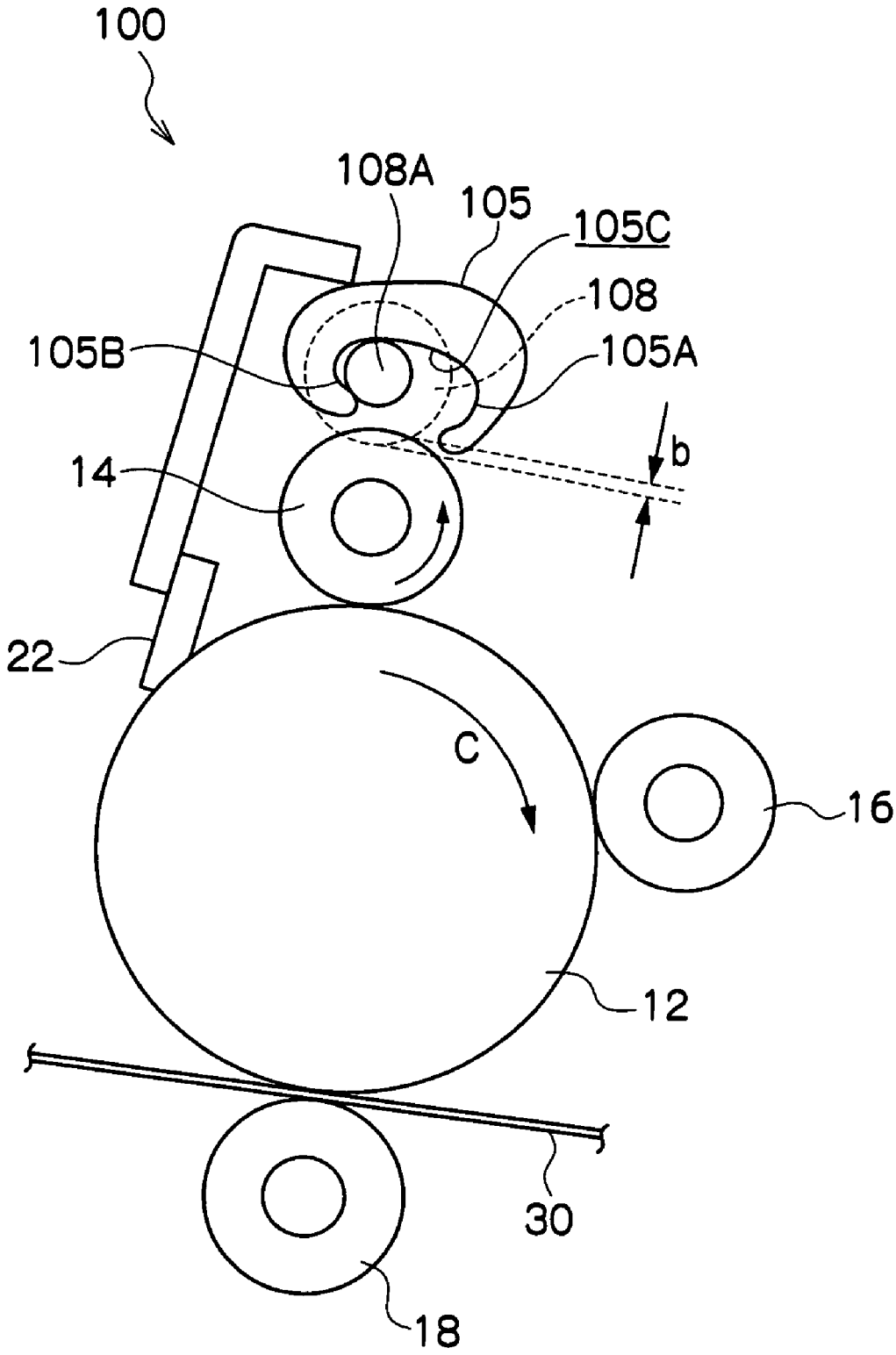
FIG. 6 is a second schematic diagram showing the cleaning device of the second exemplary embodiment of the present invention.

When the image carrier 12 and the charging roller 14 rotate in the direction of arrow C shown in FIG. 6 in accordance with use of the image forming device 10, the charging roller 14 and the cleaning member 108 contact one another while pressing one another, and therefore, the cleaning member 108 moves to the operation position 105B shown in FIG. 6. At the operation position 105B, the charging roller 14 and the cleaning member 108 are in a state of interference by distance b. This amount of compression is set such that the cleaning member 108 can effectively clean the surface of the charging roller 14.

The second exemplary embodiment does not have the urging member 106 which urges the cleaning member 108 as does the first exemplary embodiment. Therefore, after the image forming device 10 stops, by rotating the charging roller 14 reversely for a predetermined time period, the cleaning member 108 returns to the standby position 105A. In this case, it is preferable to structure the shaft 108A of the cleaning member 108 and the curved guide groove 105C formed in the supporting member 105 such that there is little friction therebetween, and to set the shaft 108A and the guide groove 105C such that the movement of the cleaning member 108 due to the rotation of the charging roller 14 is smooth. Of course, the second exemplary embodiment also may be structured such that the urging member 106 is provided between the supporting member 105 and the cleaning member 108 in the same way as in the first exemplary embodiment.

Further, in order to maintain high positional accuracy among the respective structural members in FIG. 6, it is preferable that the charging roller 14, the image carrier 12, the cleaning blade 22, and the supporting member 105 be structured as a cartridge in which they are arranged and fixed within the same casing.

EXAMPLES

The present invention will be described more concretely hereinafter with reference to Examples, but the scope of the present invention is of course not to be limited by these Examples.

The present Examples are carried out by using the image forming device 10 of the structure shown in FIGS. 1 and 3. More specifically, in the structure of FIG. 3, a member in which a polyurethane layer is fixed to the fixing member 107 of a thickness of 2 mm is used as the cleaning member 108. Here, a layer which is plate-shaped and has a layer thickness of 5 mm, a width of 10 mm, and a length, in the axial direction of the charging roller 14, of 300 mm, is used as the polyurethane layer. The number of cells at the surface of the polyurethane layer is 45 cells/25 mm.

To briefly describe the manufacturing method by using polyurethane as an example, polyol, isocyanate, water, a catalyst (an amine catalyst, a metal catalyst, or the like), and a foam stabilizer (surfactant) are used, and further, additives such as pigment or the like are used depending on the application. Then, when these raw materials are mixed-together and stirred, a chemical reaction takes place, and a foam of urethane resin can be obtained.

The outer diameter of the charging roller 14 is 18 mm. The shaft 14A is made of stainless steel, and urethane resin is used for the elastic layer. A material in which carbon black is dispersed and compounded in acrylic resin is used as the protective layer on the surface thereof. The resistance value of the protective layer which carries out charging is $10^8$ Ωcm, and the film thickness thereof is 50 μm. Further, the outer diameter of the image carrier 12 is 60 mm, and, in the image forming device 10, the image carrier 12 rotates at a process speed of 220 mm/sec.

The charging roller 14 abuts the image carrier 12 due to its own weight, and driving is transferred from the image carrier 12 to the charging roller 14 due to the surface frictional force between the both. Further, compression springs having a natural length of 15 mm and a spring constant of 0.11 (N/mm) are used as the urging members 106. The urging members 106 are disposed at two places at the longitudinal direction end portions of the cleaning member 108, and are connected to the supporting member 105. The supporting member 105 and the fixing member 107 are molded by using polyacetal.

Figure 7:
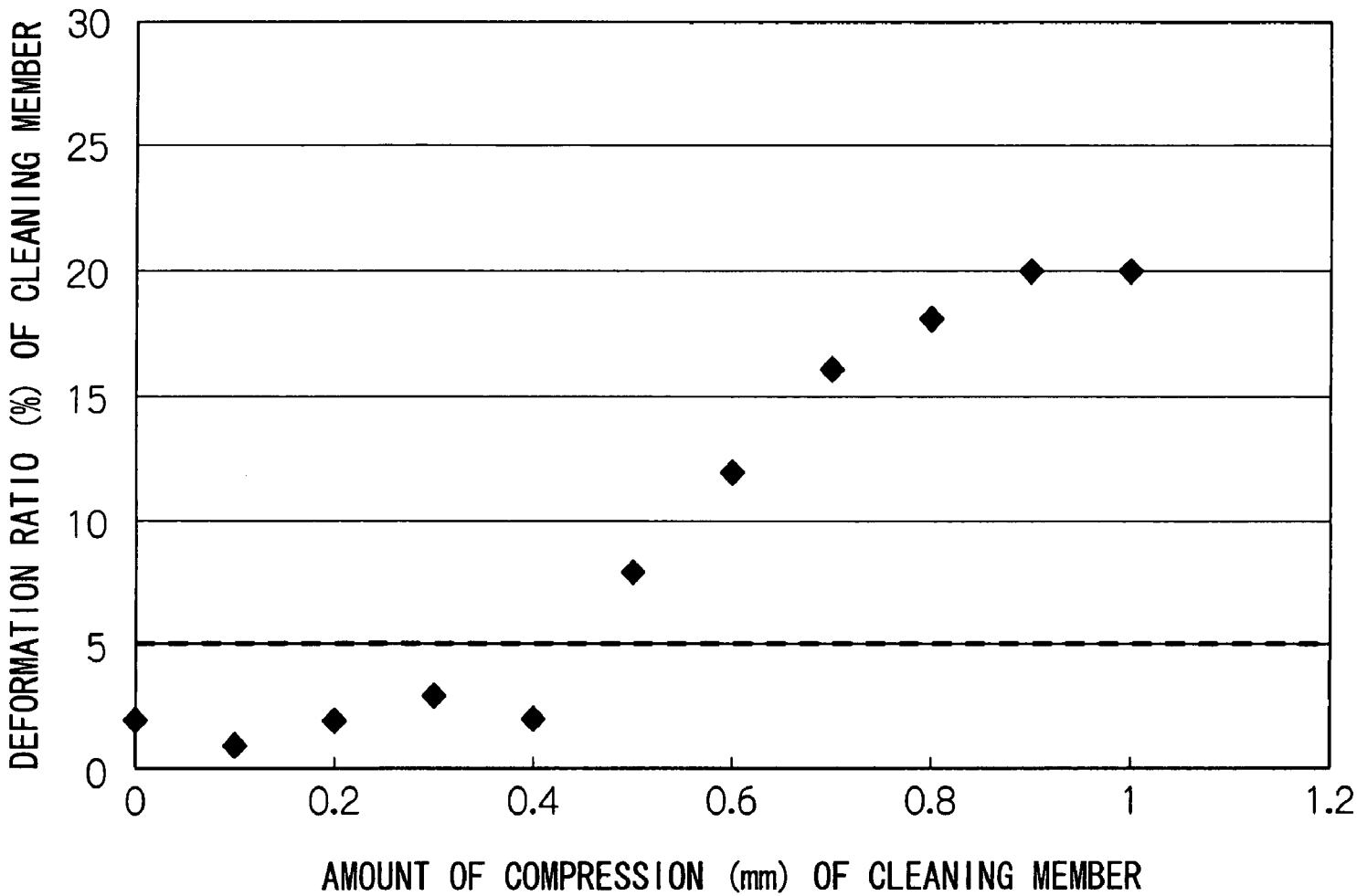
FIG. 7 is a graph showing the evaluation of deformation of a cleaning member in an Example of the present invention.

First, evaluation of the deformation of the cleaning member 108, in a case in which the stationary state of the cleaning member 108 is maintained at the standby position 105A in FIG. 3, is carried out. As shown in FIG. 7, it is preferable for the amount of compression of the cleaning member 108 at the standby position 105A to be less than or equal to 0.40 mm, so that the cleaning member 108 does not deform by greater than or equal to 5% at the standby position 105A, i.e., so that the cleaning performance thereafter is not affected. In the present Example, 0.30 mm is selected, and the following evaluation is carried out.

Figure 8:
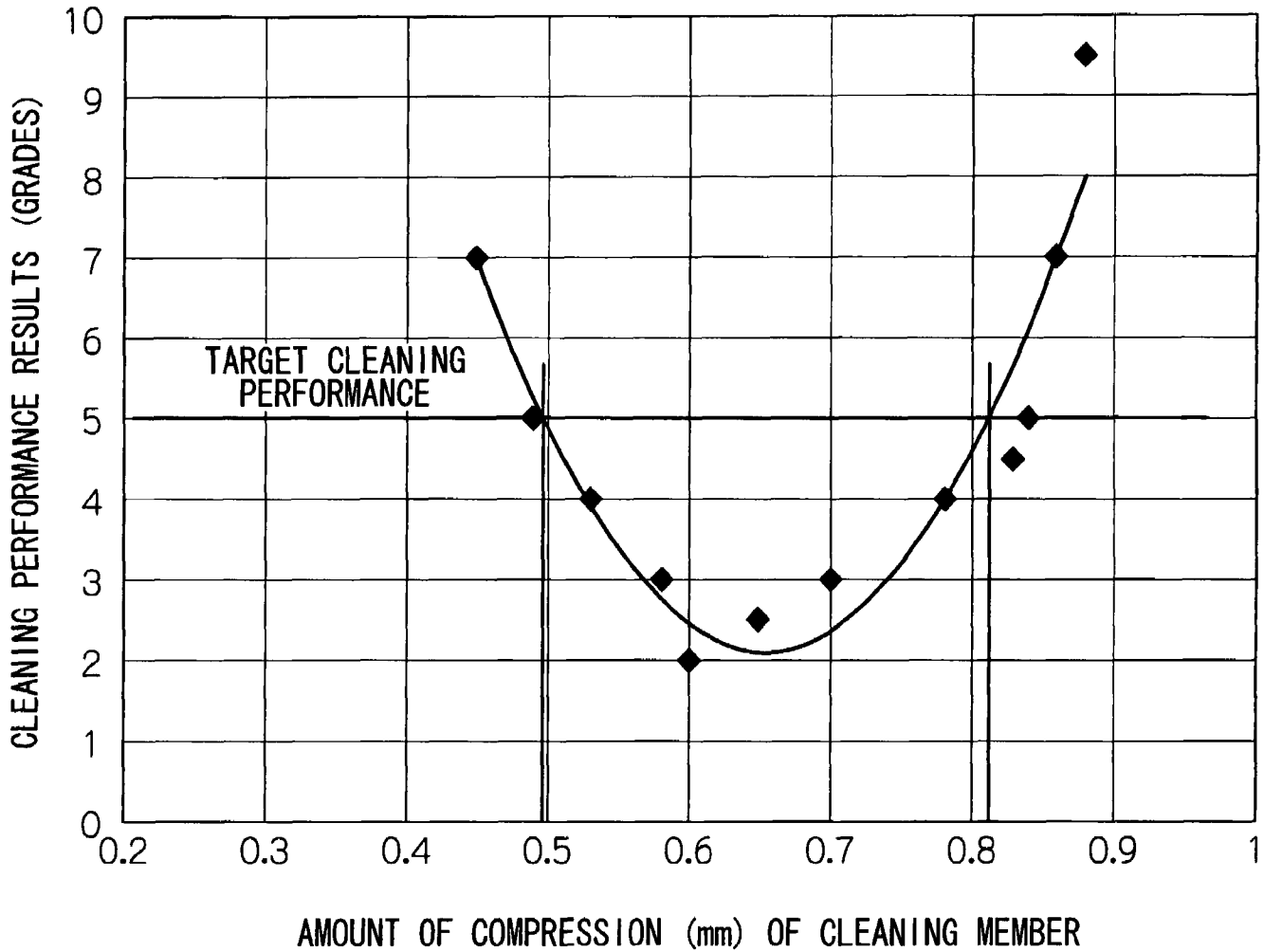
FIG. 8 is a graph showing the evaluation of cleaning performance in the Example of the present invention.

Next, the results of evaluation of the cleaning performance, in a case in which the amount of compression of the cleaning member 108 and the charging roller 14 is varied at the operation position 105B shown in FIG. 4 at which the cleaning member 108 cleans the surface of the charging roller 14, are shown in FIG. 8. Note that the evaluation of the cleaning performance is carried out under the condition that a toner image of a halftone image density of 20% is formed on the surface of the charging roller 14. The grades of the evaluation which express the cleaning performance are in levels from grade 1 to grade 10. A state in which poor cleaning on the surface of the charging roller 14, i.e., incomplete rubbing-off of the toner, can barely be confirmed visually, is given a grade of 6. In the present Example, the target cleaning performance is a grade 5. As shown in FIG. 8, it can be understood that a preferable cleaning performance is obtained by making the amount of compression of the cleaning member 108 be from 0.5 mm to 0.8 mm.

Next, evaluation of the moving performance of the cleaning member 108 moving between the standby position 105A and the operation position 105B is carried out. FIG. 9 shows the results of evaluating the movability of the cleaning member 108 by using three indices. Namely, index 1 is the results of evaluation as to whether or not the rotation of the charging roller 14 can cause the cleaning member 108 to move from the standby position 105A to the operation position 105B. Index 2 is the results of evaluation as to whether or not, with the charging roller 14 stopped, the cleaning member 108 can return from the operation position 105B to the standby position 105A. Index 3 is the results of evaluation as to whether or not, with the charging roller 14 rotating reversely, the cleaning member 108 can return from the operation position 105B to the standby position 105A.

From these results, it can be understood from index 1 that it is preferable that the amount of compression is from 0.40 mm to 0.90 mm, and thereamong, at index 2, it is preferable that the amount of compression be less than or equal to 0.75 mm. Further, from the standpoint of index 3, it can be understood that, even outside of the range of index 2, if the amount of compression is less than or equal to 0.85 mm, a good moving performance is achieved.

From these results, in employing the present Example, in order to achieve a suitable cleaning performance and for the cleaning member 108 to return from the operation position 105B to the standby position 105A due to stopping of the charging roller 14, the amount of compression of the cleaning member 108 and the charging roller 14 must be from 0.40 mm to 0.75 mm. Further, if a mechanism that rotates the charging roller 14 reversely can be provided at the image forming device 10, the aforementioned amount of compression can be from 0.40 mm to 0.80 mm (the upper limit in this case is determined by the cleaning performance of FIG. 8). Accordingly, by subtracting these values from the sum of the thickness of the cleaning member 108 and the thickness of the fixing member 107, the distance between the surface of the charging roller 14 and the supporting member 105 at the operation position 105B can be selected.

As described above, in the present Example, it is possible to obtain a structure which has a suitable cleaning performance, and in which the cleaning member 108 can move between the standby position 105A and the operation position 105B, and in which deformation of the cleaning member 108 does not arise at the standby position 105A. Note that the distances between the surface of the charging roller 14 and the supporting member 105 at the standby position 105A and at the operation position 105B in the present Example are as follows.

standby position 105A: thickness (5 mm) of cleaning member 108+thickness (2 mm) of fixing member 107−amount of compression (0.30 mm)=6.70 mm operation position 105B (a case in which the cleaning member 108 returns to the standby position 105A with the rotation of the charging roller 14 stopped): thickness (5 mm) of cleaning member 108+thickness (2 mm) of fixing member 107−amount of compression (0.40 mm to 0.75 mm)=6.25 mm to 6.60 mm operation position 105B (a case in which the cleaning member 108 returns to the standby position 105A with the rotation of the charging roller 14 stopped or the charging roller 14 rotating reversely): thickness (5 mm) of cleaning member 108+thickness (2 mm) of fixing member 107−amount of compression (0.40 mm to 0.80 mm)=6.20 mm to 6.60 mm As described above, in the cleaning device 100 relating to the exemplary embodiments of the present invention, contact between the image carrier 12 and the charging roller 14, for example, at the stage when the image forming device 10 is being shipped-out can be prevented, and image defects arising due to such contact can be reduced.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a cleaning member that contacts a charging roller which charges an image carrier which carries an image, and cleans a surface of the charging roller; and a holding structure that holds the cleaning member such that the cleaning member is movable at least between a first position and a second position along a peripheral direction of the charging roller, the holding structure including a first supporting member that supports the cleaning member at the first position and a second supporting member that supports the cleaning member at the second position, the holding structure holding the cleaning member such that an amount of compression of the cleaning member at a contacting portion of the charging roller and the cleaning member is greater at the second position than at the first position.

2. The cleaning device of claim 1, wherein the cleaning member receives rotational force from the charging roller, and moves from the first position to the second position.

3. The cleaning device of claim 1, wherein the cleaning member moves from the second position to the first position accompanying stoppage of or reverse rotation of the charging roller.

4. The cleaning device of claim 1, wherein a distance between the first supporting member and the charging roller is set to be greater than that between the second supporting member and the charging roller.

5. The cleaning device of claim 1, wherein the holding structure has an urging member urging the cleaning member in a direction heading from the second position toward the first position.

6. An image forming device comprising:

an image carrier that carries an image;

a charging roller that charges the image carrier; and a cleaning device that cleans the charging roller, the cleaning device having:

a cleaning member that contacts the charging roller, and cleans a surface of the charging roller; and a holding structure holding the cleaning member such that the cleaning member is movable at least between a first position and a second position along a peripheral direction of the charging roller, the holding structure including a first supporting member that supports the cleaning member at the first position and a second supporting member that supports the cleaning member at the second position, the holding structure holding the cleaning member such that an amount of compression of the cleaning member at a contacting portion of the charging roller and the cleaning member is greater at the second position than at the first position.

7. The image forming device of claim 6, wherein the cleaning member receives rotational force from the charging roller, and moves from the first position to the second position.

8. The image forming device of claim 6, wherein the cleaning member moves from the second position to the first position accompanying stoppage of or reverse rotation of the charging roller.

9. The image forming device of claim 6, wherein a distance between the first supporting member and the charging roller is set to be greater than that between the second supporting member and the charging roller.

10. The image forming device of claim 6, wherein the holding structure has an urging member urging the cleaning member in a direction heading from the second position toward the first position.

11. A method of cleaning a charging roller, comprising:

providing a cleaning member, that cleans a surface of a charging roller which charges an image carrier which carries an image;

providing a holding structure including a first supporting member that supports the cleaning member at a first position and a second supporting member that supports the cleaning member at a second position;

rotating the charging roller; and moving the cleaning member along a peripheral direction of the charging roller from the first position to the second position, the moving giving rise to a state in which an amount of compression of the cleaning member at a contacting portion of the charging roller and the cleaning member is greater at the second position than at the first position.

12. The method of cleaning of claim 11, wherein the cleaning member receives rotational force from the charging roller, and moves from the first position to the second position.

13. The method of cleaning of claim 11, wherein the cleaning member moves from the second position to the first position accompanying stoppage of or reverse rotation of the charging roller.

14. The method of cleaning of claim 11, wherein a distance between the first supporting member and the charging roller is set to be greater than that between the second supporting member and the charging roller.

15. The method of cleaning of claim 11, further comprising urging the cleaning member in a direction heading from the second position toward the first position.

* * * * *